US008714143B1

(12) United States Patent
Darlington

(10) Patent No.: US 8,714,143 B1
(45) Date of Patent: May 6, 2014

(54) COMPOUND ARCHERY BOW

(76) Inventor: Rex F. Darlington, Whittemore, MI (US)

( * ) Notice: Subject to any disclaimer, the term of this patent is extended or adjusted under 35 U.S.C. 154(b) by 201 days.

(21) Appl. No.: 13/281,570

(22) Filed: Oct. 26, 2011

Related U.S. Application Data

(60) Provisional application No. 61/455,792, filed on Oct. 26, 2010.

(51) Int. Cl.
*F41B 5/10* (2006.01)

(52) U.S. Cl.
CPC ..... *F41B 5/105* (2013.01); *Y10S 124/90* (2013.01)
USPC ..... 124/25.6; 124/900

(58) Field of Classification Search
CPC ..... F41B 5/105
USPC ..... 124/25.6, 900
See application file for complete search history.

(56) References Cited

U.S. PATENT DOCUMENTS

| | | | | |
|---|---|---|---|---|
| 4,593,674 | A * | 6/1986 | Kudlacek | 124/25.6 |
| 4,686,955 | A * | 8/1987 | Larson | 124/25.6 |
| 4,774,927 | A * | 10/1988 | Larson | 124/25.6 |
| 4,976,250 | A * | 12/1990 | Jeffrey | 124/25 |
| 6,250,293 | B1 * | 6/2001 | Andrews | 124/25.6 |
| 6,360,735 | B1 * | 3/2002 | Larson et al. | 124/25.6 |
| 6,871,643 | B2 * | 3/2005 | Cooper et al. | 124/25.6 |
| 7,690,372 | B2 * | 4/2010 | Cooper et al. | 124/25.6 |

* cited by examiner

*Primary Examiner* — Alvin Hunter
*Assistant Examiner* — Alexander Niconovich
(74) *Attorney, Agent, or Firm* — Reising Ethington PC

(57) ABSTRACT

A compound archery bow that includes a handle, at least one limb mounted on the handle, a pulley mounted for rotation on the limb, and a bowstring lying in a bowstring groove around at least a portion of the periphery of the pulley. In one embodiment, the bowstring groove has a depth at least 10% greater than the diameter of the portion of the bowstring that lies in the groove. In another embodiment, the bowstring groove on the pulley is of non-uniform depth, having a greatest depth about midway through the portion of the power stroke that builds to peak force and then decreasing in both directions from that point.

10 Claims, 4 Drawing Sheets

COMPOUND ARCHERY BOW

This patent application claims priority from application 61/455,792.

The present disclosure relates to compound archery bows having at least one limb and a pulley on the end of the limb to control the force/draw characteristics of the bow.

BACKGROUND AND SUMMARY OF THE DISCLOSURE

Single-cam and dual-cam compound archery bows have a power cam mounted on one or both ends of the bow limbs to control the draw force on the bowstring and bending of the limbs as the bowstring is drawn. In single-cam bows, there is a power cam on the end of one bow limb and a wheel on the end of the other bow limb to facilitate let-out of the bowstring as the bow is drawn. In dual-cam bows, power cams are mounted on the ends of both bow limbs, with each cam including groove segments to control let-out of the bowstring.

As bow performance has improved, there can be a problem of the bowstring staying in its let-out groove after the bowstring has been released by a user. This problem can be aggravated if the bow user torques or twists the bow handle so that the plane of the bowstring grooves on the pulleys moves away from the plane of travel of the bowstring. The use of bowstring bumpers, which are attached to the bow handle and cushion the bowstring at the end of the power stroke, sometimes tends to help alleviate this problem, but does not eliminate it. In some cases, the presence and/or location of the bumper annoys the shooter. High-performance bows can have a bowstring derailing problem when the user uses his or her fingers, rather than a mechanical release, to draw and release the bowstring. A general object of the present disclosure is to provide a pulley for a compound archery bow, and a compound archery bow that includes such a pulley, that reduces or eliminates the problem of bowstring derailing.

In current bow designs, the depth of the bowstring groove on the pulley is constant and equal to or slightly less than the bowstring diameter. In accordance with one aspect of the present disclosure, the radial depth of the bowstring groove on the pulley is at least 10% greater than the diameter of the portion of the bowstring that lies in the groove. In accordance with another aspect of the disclosure, the radial depth of the bowstring groove is non-constant around the periphery of its pulley, preferably being greatest about midway through the portion of the power stroke that builds to peak force, and then decreasing in both directions at the nose of the pulley and rest of the pulley's circumference.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
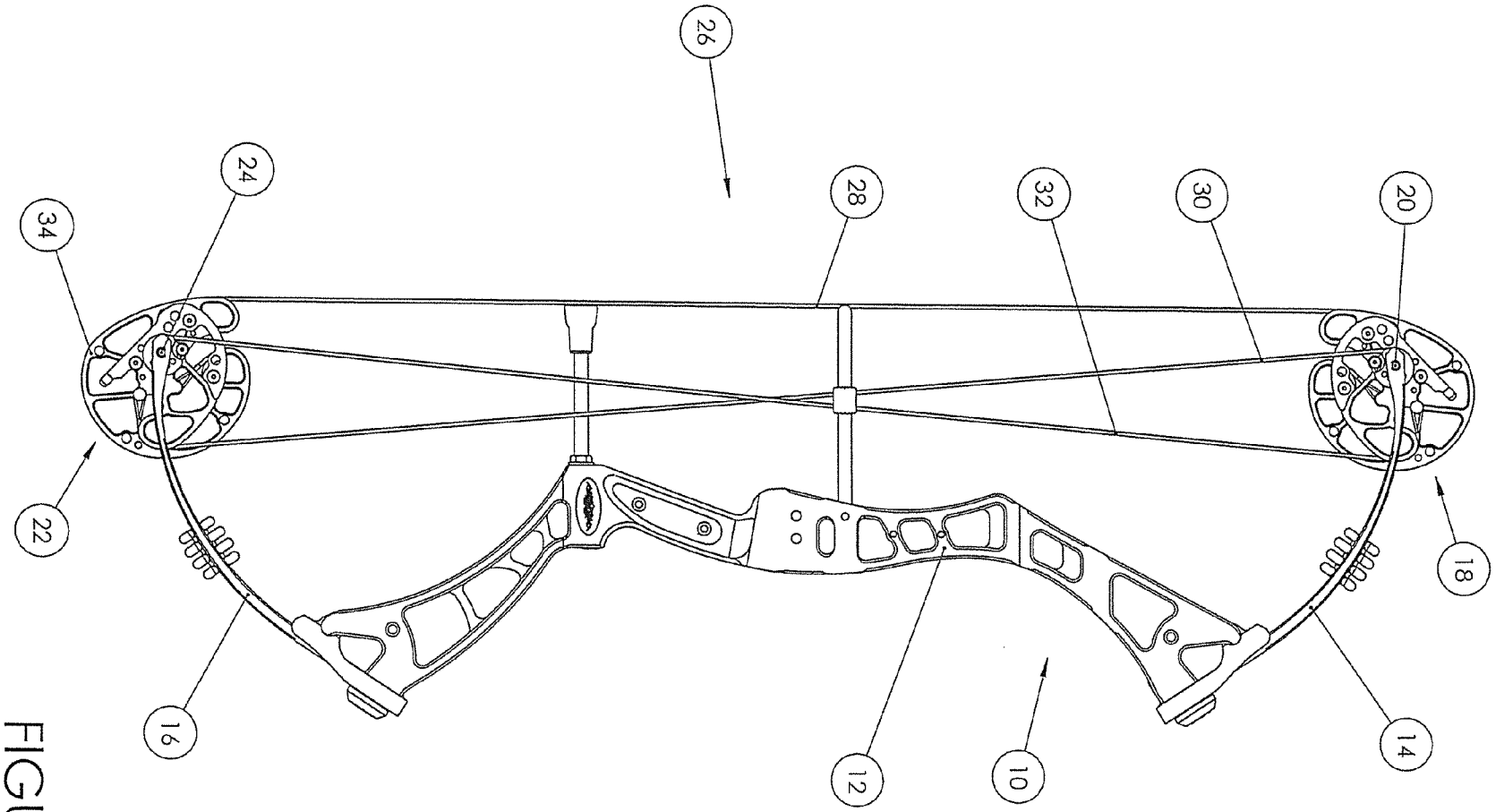
FIG. 1 is an elevational view of a compound archery bow in accordance with an exemplary embodiment of the present disclosure.

FIG. 1 illustrates a dual-cam compound archery bow 10 in accordance with an exemplary embodiment of the present disclosure as including a handle 12 of aluminum or other relatively rigid construction having spaced risers with bow-limb mounting surfaces at the ends. A pair of flexible resilient limbs 14, 16 of fiber-reinforced resin or other suitable resilient construction are mounted on the respective handle risers and project away from handle 12. An upper pulley 18 is mounted on limb 14 for rotation around an axle 20, and a lower pulley 22 is mounted on limb 16 for rotation around an axle 24. Pulleys 18, 22 in this embodiment are similar in function and preferably are near mirror images of each other. Upper pulley 18 can be slightly larger than lower pulley 22 to compensate for the arrow rest on handle 12 not being at the true center of the bow. The pulleys also can be made non-identical in areas that are non-functional to create a desired difference in appearance. A bow cable arrangement 26 includes a bowstring 28 and power cables 30, 32 extending between pulleys 18, 22. The bowstring 28 extends around bowstring portions 34 of the pulley 18, 22. A bowstring cushion or bumper is mounted on handle 12.

Figure 2:
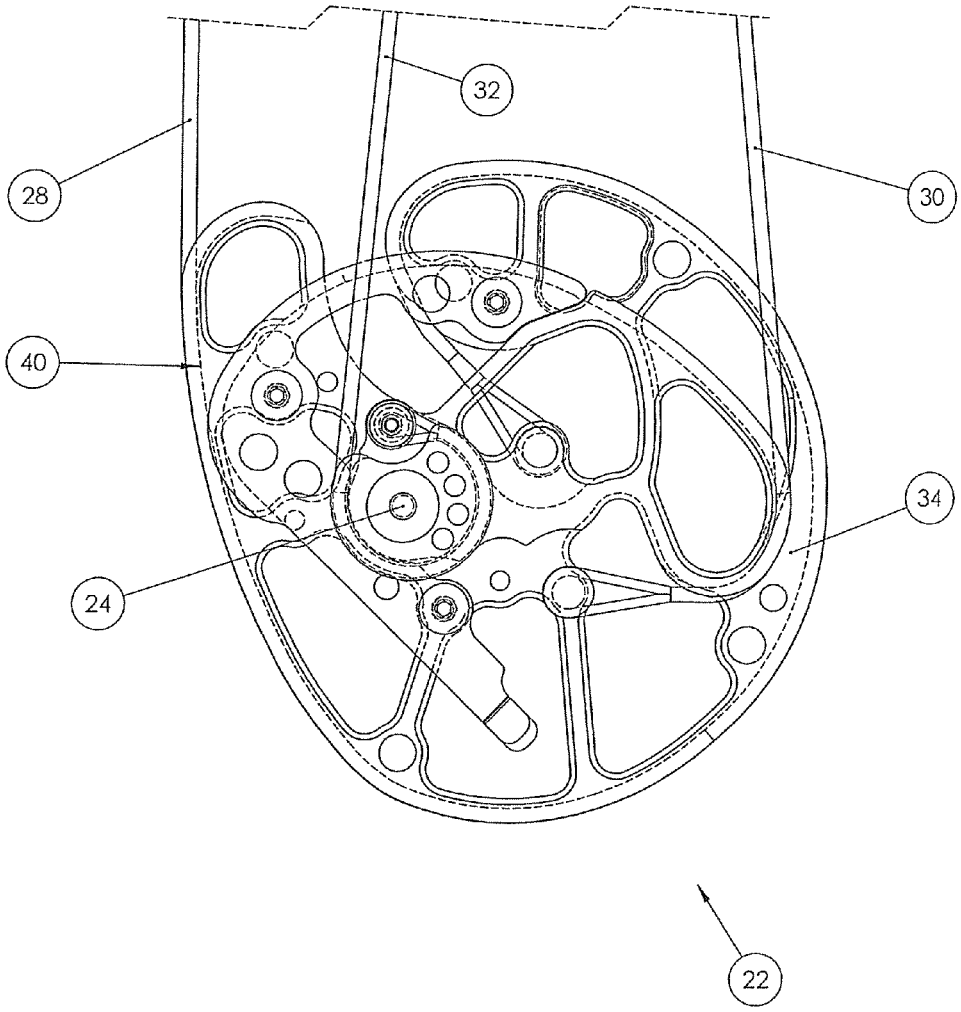
(PRIOR ART) FIGURE 2
FIG. 2 is an elevation view on an enlarged scale of the lower pulley in a bow of the type in FIG. 1 in accordance with current technology.

FIG. 2 illustrates lower pulley 22 having a peripheral bowstring let-out groove or channel 40. According to conventional technology, groove 40 has a radial depth equal to or slightly less than the diameter of the portion of bowstring 28 that lies in the groove.

Figure 3:
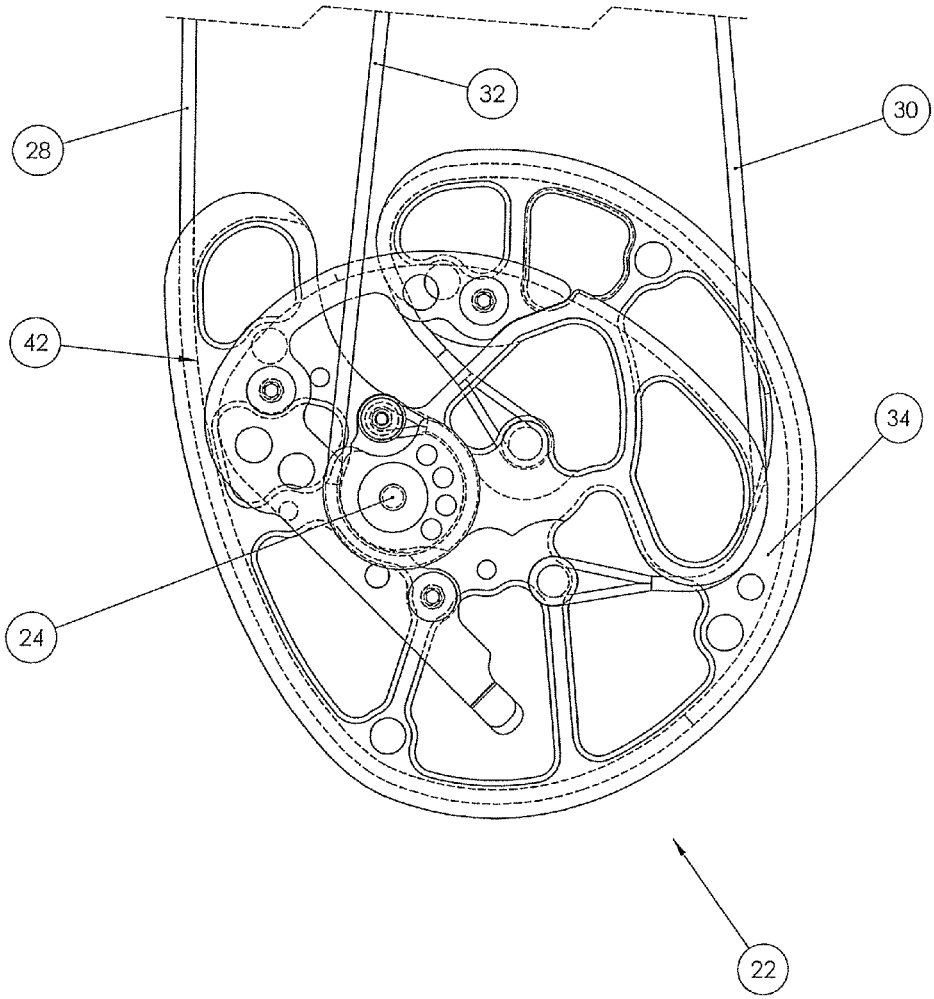
FIG. 3 is an elevational view of the lower pulley in the bow of FIG. 1.

FIG. 3 illustrates a lower pulley 22 in accordance with one embodiment of the present disclosure having a peripheral bowstring let-out groove 42 of greater depth. Groove 42 preferably has a radial depth at least 10% greater than the diameter of the portion of the bowstring that lies in the groove.

Figure 4:
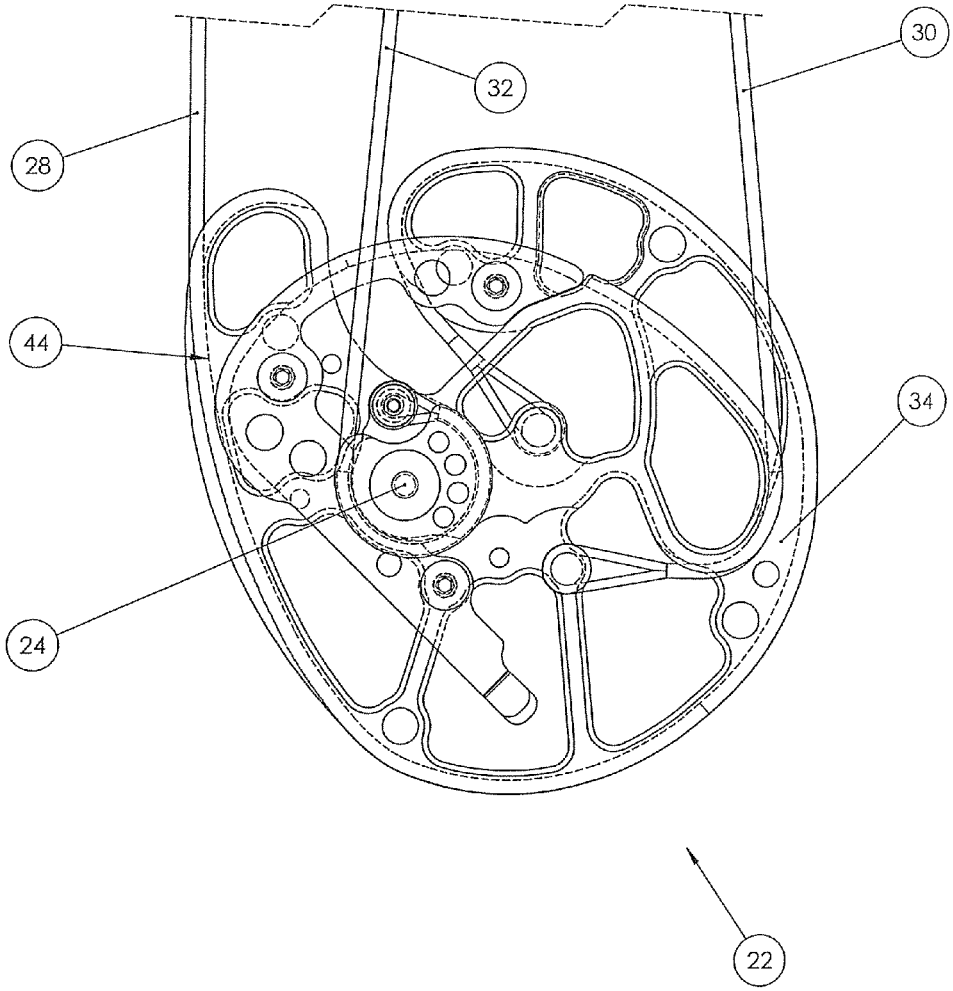
FIG. 4 is an elevational view of a lower pulley in a modified embodiment of the present disclosure.

FIG. 4 illustrates another embodiment of the present disclosure, in which the bowstring let-out groove 44 is of non-uniform depth around the periphery of the pulley 22. The depth of groove 44 preferably is greater during the first part of the power stroke. A preferred design has the groove depth at its maximum approximately midway through the portion of the power stroke that builds to peak force, and then decrease in both directions from that maximum point to a depth approximately equal to the diameter of the bowstring portion that lies in the groove.

There thus has been disclosed a compound archery bow, and a pulley for a compound archery bow, that fully satisfy all of the objects and aims previously set forth. The bow and pulley have been disclosed in conjunction with exemplary embodiments, and modifications and variations have been discussed. Other modifications and variations readily will suggest themselves to persons of ordinary skill in the art in view of the foregoing discussion. For example, although the disclosure has been presented in conjunction with dual-cam compound archery bows, the subject matter of the disclosure could as readily be implemented in single-cam bows or hybrid bows of the types disclosed in U.S. Pat. Nos. 6,516,790, 6,990,970 and RE37,544. The disclosure is intended to embrace all such modifications and variations as fall within the spirit and broad scope of the appended claims.

The invention claimed is:

1. A compound archery bow that includes a handle, at least one limb mounted on said handle, a pulley mounted for rotation on said limb and having a bowstring groove extending around at least a portion of a periphery of a bowstring portion of said pulley, and a bowstring having a portion lying in said groove and extending across said handle for drawing by a user, wherein a portion of said bowstring groove on said pulley has a depth at least 10% greater than a diameter of said portion of said bowstring lying in said groove, and said bowstring groove is of non-uniform depth and is greater during a first part of a power stroke.

2. The bow set forth in claim 1 wherein said non-uniform depth is greatest midway through the portion of the power stroke that builds to peak force and decreases in depth in both directions from that point.

3. The bow set forth in claim 1 wherein said non-uniform depth is greatest midway through the portion of the power stroke that builds to peak force and decreases in depth in both directions from that point to a depth approximately equal to the diameter of the bowstring portion that lies in the groove.

4. The bow set forth in claim 1 wherein the non-uniform depth is greatest on a portion of said pulley that is on a side of a pulley axle opposite that of said handle.

5. A compound archery bow that includes a handle, at least one limb mounted on said handle, a pulley mounted for rotation on said limb and having a bowstring groove extending around at least a portion of a periphery of a bowstring portion of said pulley, and a bowstring having a portion lying in said groove and extending across said handle for drawing by a user, wherein said bowstring groove on said pulley has a non-uniform depth and is greater during a first part of a power stroke.

6. The bow set forth in claim 5 wherein said non-uniform depth is greatest midway through the portion of the power stroke that builds to peak force and decreases in depth in both directions from that point.

7. The bow set forth in claim 5 wherein said non-uniform depth is greatest midway through the portion of the power stroke that builds to peak force and decreases in depth in both directions from that point to a depth approximately equal to the diameter of the bowstring portion that lies in the groove.

8. The bow set forth in claim 5 wherein the non-uniform depth is greatest on a portion of said pulley that is on a side of a pulley axle opposite that of said handle.

9. A compound archery bow that includes a handle, at least one limb mounted on said handle, a pulley mounted for rotation on said limb and having a bowstring groove extending around at least a portion of a periphery of a bowstring portion of said pulley, and a bowstring having a portion lying in said groove and extending across said handle for drawing by a user, wherein said bowstring groove on said pulley has a non-uniform depth that is greatest midway through the portion of the power stroke that builds to peak force and decreases in depth in both directions from that point.

10. A pulley for a compound archery bow having a periphery and a bowstring groove extending at least part-way around a bowstring portion of said periphery, wherein said groove has a non-uniform depth and is greater at a location distal from a bowstring anchor on said pulley.

* * * * *